US005110543A

United States Patent [19]

Odani et al.

[11] Patent Number: 5,110,543

[45] Date of Patent: May 5, 1992

[54] CEMENT BLADE MEMBER FOR CUTTING-TOOLS AND PROCESS FOR PRODUCING SAME

[75] Inventors: Niro Odani; Kazuyoshi Yoshioka; Sinichi Sekiya, all of Tokyo, Japan

[73] Assignee: Mitsubishi Metal Corporation, Tokyo, Japan

[21] Appl. No.: 733,081

[22] Filed: Jul. 19, 1991

Related U.S. Application Data

[62] Division of Ser. No. 435,200, Nov. 9, 1989, Pat. No. 5,059,491.

[30] Foreign Application Priority Data

Nov. 11, 1988 [JP] Japan ..... 63-285215

[51] Int. Cl.[5] ..... B22F 3/16; C22C 19/00

[52] U.S. Cl. ..... 419/29; 419/26; 419/54; 419/57

[58] Field of Search ..... 419/13, 14, 18, 36, 419/37, 54, 57, 26, 29; 428/614

[56] References Cited

U.S. PATENT DOCUMENTS

| | | | |
|---|---|---|---|
| 4,334,928 | 6/1982 | Hara et al. | 75/238 |
| 4,587,095 | 5/1986 | Yoshimura et al. | 419/13 |
| 4,619,698 | 10/1986 | Ueda et al. | 75/238 |
| 4,778,521 | 10/1988 | Iyori et al. | 75/238 |
| 4,935,057 | 6/1990 | Yoshimura et al. | 75/238 |

FOREIGN PATENT DOCUMENTS

| | | |
|---|---|---|
| 0259192 | 3/1988 | European Pat. Off. . |
| 0302635 | 2/1989 | European Pat. Off. . |
| 0337696 | 10/1989 | European Pat. Off. . |
| 52-134614 | 11/1977 | Japan . |
| 54-2912 | 1/1979 | Japan . |
| 54-87719 | 7/1979 | Japan . |
| 54-103709 | 8/1979 | Japan . |
| 56-5946 | 1/1981 | Japan . |
| 56-20141 | 2/1981 | Japan . |
| 56-152937 | 11/1981 | Japan . |
| 58-213843 | 12/1983 | Japan . |
| 61-186434 | 8/1986 | Japan . |
| 61-213339 | 9/1986 | Japan . |
| 61-243139 | 10/1986 | Japan . |
| 61-281835 | 12/1986 | Japan . |
| 62-278267 | 12/1987 | Japan . |
| 63-99103 | 4/1988 | Japan . |

*Primary Examiner*—Brooks H. Hunt
*Assistant Examiner*—Daniel J. Jenkins
*Attorney, Agent, or Firm*—Scully, Scott, Murphy & Presser

[57] ABSTRACT

A blade member for cutting-tools includes a cermet substrate which contains, apart from unavoidable impurities, a binder phase and a hard dispersed phase. The binder phase contains 5% to 30% by weight of cobalt and/or nickel. The hard dispersed phase contains a balance composite carbonitride of titanium and one or more of the elements tungsten, molybdenum, tantalum, niobium, hafnium and zirconium. The composite carbonitride satisfies the relationship $0.2 \leqq b/(a+b) \leqq 0.7$, where a and b denote atomic ratios of carbon and nitrogen, respectively. The substrate includes a hard surface layer in which the maximum hardness is present at a depth between 5 μm and 50 μm from a substrate surface thereof. The substrate surface has a hardness of 20% to 90% of the maximum hardness.

2 Claims, 2 Drawing Sheets

CEMENT BLADE MEMBER FOR CUTTING-TOOLS AND PROCESS FOR PRODUCING SAME

This is a divisional of copending application Ser. No. 435,200, filed on Nov. 9, 1989, now U.S. Pat. No. 5,059,491.

BACKGROUND OF THE INVENTION

1. Field of the Invention

The present invention relates to a cermet blade member which is particularly suitable for cutting-tools used in interrupted cutting operations under particularly severe conditions.

2. Prior Art

As disclosed in Japanese Unexamined Patent Application Publication No. 54-139815, there was hitherto developed a cermet blade member which consists, apart from unavoidable impurities, of a binder phase of 5% to 30% by weight of at least one of cobalt (Co) and nickel (Ni); and a dispersed phase of a balance composite carbo-nitride of titanium (Ti) with at least one of the elements of tungsten (W), molybdenum (Mo), tantalum (Ta), niobium (Nb), hafnium (Hf) and zirconium (Zr); and which includes a hard surface layer wherein hardness is greatest at the surface.

The aforesaid cermet blade member is manufactured by a sintering method which includes heating a green compact of a prescribed blend composition to a prescribed temperature of no greater than the liquid phase-emerging temperature in a carburizing atmosphere of CO and $CH_4$, or the like, and subsequently carrying out the temperature elevating step to a sintering temperature and a subsequent holding step in a vacuum.

The aforesaid blade member exhibits a superior wear resistance when used for cutting-tools designed for high speed cutting of steel or the like. However, the blade member is susceptible to fracture or chipping when used for interrupted cutting or heavy duty cutting operations where a greater toughness and shock resistance are required, so that the blade member cannot be employed under such circumstances.

SUMMARY OF THE INVENTION

It is therefore an object of the present invention to provide a cermet blade member which not only exhibits superior wear resistance but also is less susceptible to fracture.

Another object of the invention is to provide a process for producing the above blade member.

According to a first aspect of the invention, there is provided a cermet blade member for cutting-tools, comprising a cermet substrate consisting, apart from unavoidable impurities, of a binder phase of 5% to 30% by weight of at least one element selected from the group consisting of cobalt and nickel; and a hard dispersed phase of a balance composite carbo-nitride of titanium and at least one element selected from the group consisting of tungsten, molybdenum, tantalum, niobium, hafnium and zirconium, the composite carbo-nitride satisfying the relationship of $0.2 \leqq b/(a+b) \leqq 0.7$, where a and b denote atomic ratios of carbon and nitrogen, respectively; the substrate including a hard surface layer in which the maximum hardness is present at a depth between 5 μm and 50 μm from the substrate surface thereof, the substrate surface having hardness of 20% to 90% of the greatest hardness.

According to a second aspect of the invention, there is provided a process for producing a cermet blade member for cutting-tools, comprising the steps of mixing powders for forming the binder phase and the hard dispersed phase to provide a powder mixture of a prescribed composition, compacting the powder mixture into a green compact, and sintering the green compact to provide the substrate of cermet, the sintering step including initial temperature elevation in a non-oxidizing atmosphere and subsequent temperature elevation to a temperature ranging from 1,100° C. to 1,500° C. in a nitrogen atmosphere, and a subsequent sintering operation in a denitrifying atmosphere such as vacuum.

DETAILED DESCRIPTION OF THE INVENTION

Figure 1:
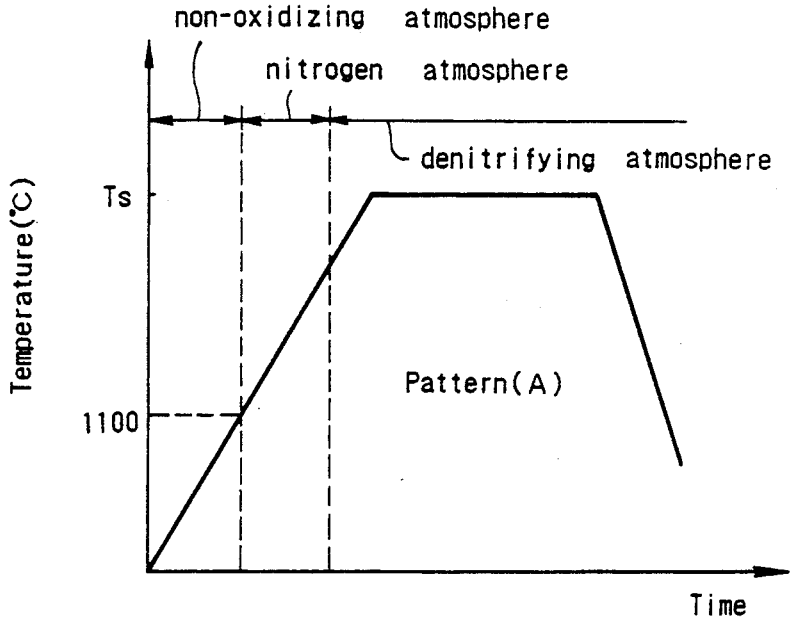
FIGS. 1 to 4 are diagrammatical representations showing several patterns of the sintering process in accordance with the process of the invention.

The inventors have made an extensive study in order to improve the prior art cermet blade member and have produced a blade member in accordance with the present invention which comprises a cermet substrate consisting, apart from unavoidable impurities, of a binder phase of 5% to 30% by weight of at least one element selected from the group consisting of cobalt and nickel, and a hard dispersed phase of a balance composite carbo-nitride of titanium and at least one element selected from the group consisting of tungsten, molybdenum, tantalum, niobium, hafnium and zirconium. The dispersed phase may further contain at least one compound selected from the group consisting of tungsten carbide and titanium nitride. The composite carbo-nitride is formed so as to satisfy the relationship $0.2 \leqq b/(a+b) \leqq 0.7$, where a and b denote atomic ratios of carbon and nitrogen, respectively. In addition, the substrate includes a hard surface layer having the maximum hardness at a depth of between 5 μm and 50 μm from the substrate surface thereof, and the surface has a hardness of 20% to 90% of the above-mentioned maximum hardness value.

The blade member of the aforesaid construction has superior fracture resistance characteristics, and therefore exhibits superior cutting performance when used in interrupted cutting operations of steel or the like under particularly severe conditions. In addition, the blade member also exhibits a high wear resistance, and therefore the resulting cutting-tool achieves a good performance for high speed cutting for an extended period of time.

In the foregoing, cobalt and nickel are included to improve toughness of the substrate of the blade member. Accordingly, if the cobalt content or nickel content is below 5% by weight, the resulting blade member loses the required degree of toughness. On the other hand, if the content exceeds 5% by weight, the hardness and hence the wear resistance is lowered.

Furthermore, the substrate of the above blade member is formed so that the hardest region in the hard surface layer is present at a depth of between 5 μm, and 50 μm from the substrate surface. If its position is shallower than 5 μm, the blade member cannot have desired fracture resistance characteristics. On the other hand, if the position is deeper than 50 μm, cutting edges of the blade member will be subjected to wear before the occurrence of a sufficient wear resistance effect by virtue of the hard surface layer, thereby reducing the cutting performance unduly.

In addition, the atomic ratios of carbon and nitrogen in the composite carbo-nitride have an influence on the degree of sintering for cermet and a hardness distribution in the substrate. If the ratio defined by b/(a+b) is below 0.2, the nitrogen content is too low relative to the carbon content. As a result, in conjunction with sintering conditions, the hardest region in the substrate shifts toward the substrate surface, and therefore the hardest region cannot be maintained at the previously-described desired depth ranging between 5 μm and 50 μm. On the other hand, if the above ratio exceeds 0.7, the nitrogen content is too high relative to the carbon content to maintain a sufficient degree of sintering, thereby failing to ensure the desired high degree of toughness.

Furthermore, if the hardness at the substrate surface is greater than 90% of the maximum hardness value, the difference between the hardness at the substrate surface and the maximum hardness is too small, and the blade member becomes susceptible to fracture. On the other hand, if the hardness at the substrate surface is less than 20% of the maximum hardness value, the substrate surface will be subjected to rapid wear, so that the life of the blade member is shortened.

Furthermore, in order to further improve the cutting performance, a hard coating having an average thickness of 0.5 μm to 20 μm may be formed on the substrate. The hard coating may be composed of either diamond or cubic boron nitride (CBN). The hard coating may also be composed of at least one compound selected from the group consisting of: a carbide, a nitride, an oxide and a boride of at least one element, selected from the class consisting of titanium, zirconium, hafnium, aluminum and silicon; and solid solution compounds of two or more of the carbide, nitride, oxide and boride of the at least one element The hard coating may include one or more layers.

Figure 2:
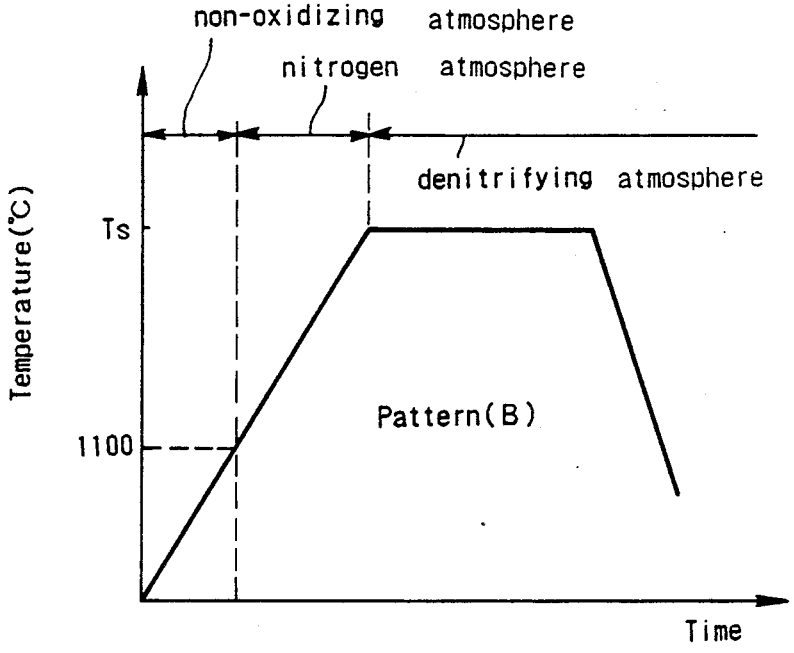
Figure 3:
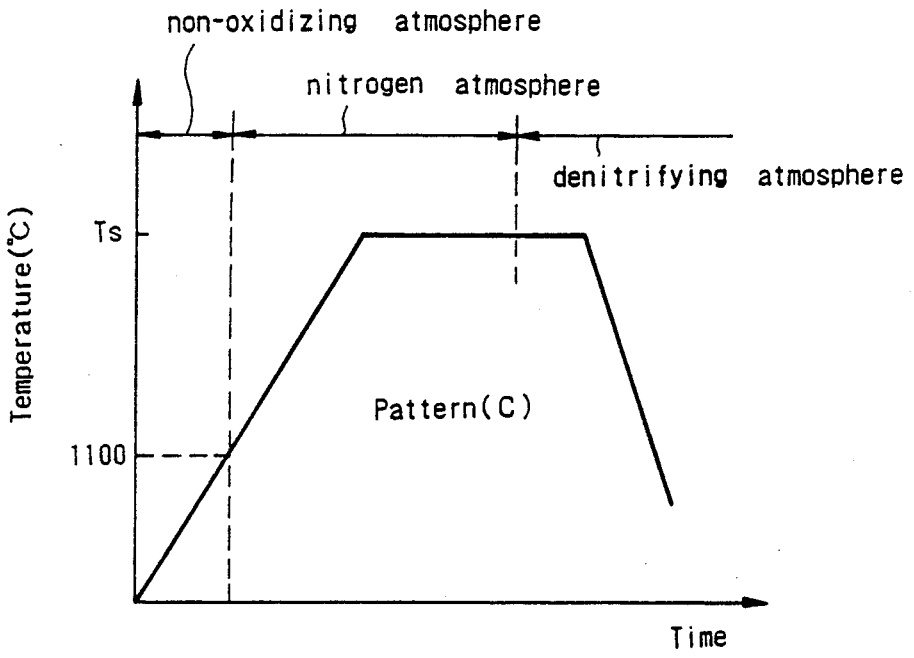
Figure 4:
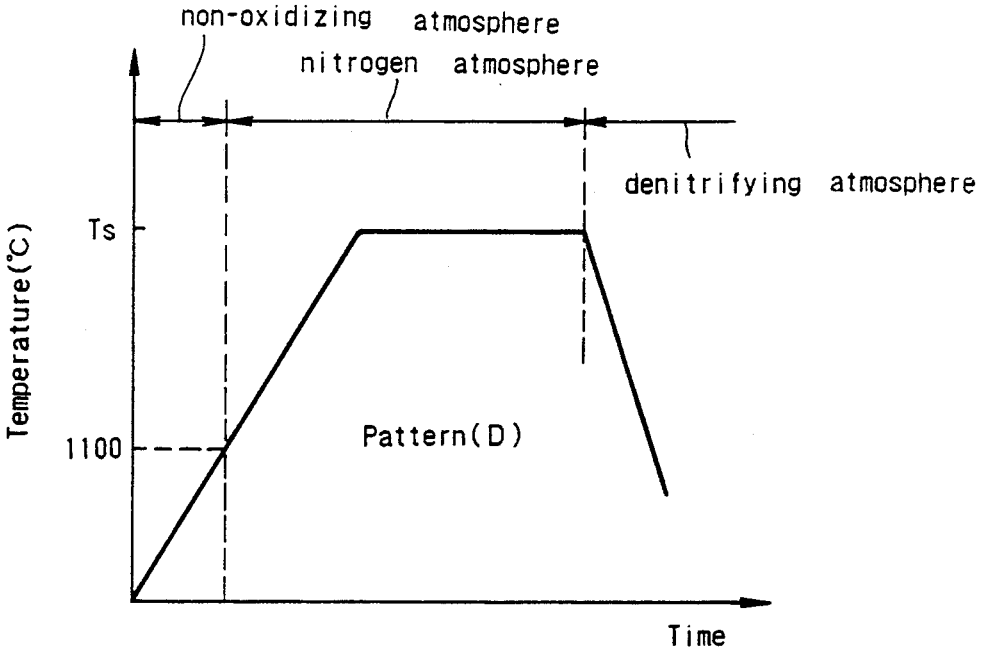

For producing the aforesaid blade member, a powder metallurgical process is utilized. Specifically, powders for forming the binder phase and the hard dispersed phase are first prepared and blended at a predetermined composition to provide a powder mixture. Thereafter, the mixture is compacted into a green compact and sintered In the sintering operation, initial temperature elevation is effected in a non-oxidizing atmosphere such as a vacuum or an inert gas atmosphere. In the subsequent temperature elevation from 1,100° C., above which nitrides or carbo-nitrides are susceptible to decomposition, to a sintering temperature Ts ranging from 1,400° C. to 1,500° C., a gaseous nitrogen atmosphere is used. Then, the subsequent sintering step including the cooling step is effected in a denitrifying atmosphere such as a vacuum. According to the above sintering process, there are four possible patterns (A), (B), (C) and (D) as depicted in FIGS. 1 to 4, respectively. Among the four patterns, (B) and (C) are preferable in order to obtain a better blade member.

The hard coating of the aforesaid construction ma be formed on the substrate thus produced by means of a known physical or chemical vapor deposition method.

In the above blade member, the position of the hardest region in the hard surface layer can be regulated by changing the ratio b/(a+b) in the composite carbonitride during the blending step or by modifying the sintering conditions. For instance, if the blending is effected so that the ratio b/(a+b) in the composite carbo-nitride in the resulting substrate becomes greater (i.e., the nitrogen content therein becomes greater), the hardest region will shift to the inner or deeper position, and accordingly the hardness at the substrate surface will be lowered. Moreover, if the sintering step in the denitrifying atmosphere is prolonged to enhance the degree of denitrification, the position of the hardest region will shift inwardly of the substrate. On the other hand, if the step in the denitrifying atmosphere is shortened, the hardest region will shift toward the substrate surface and hence the hardness at the substrate surface increases.

The present invention will now be described in detail with reference to the following example.

EXAMPLE

Powders of TiC, TiN, WC, $Mo_2C$, TaC, NbC, HfC, ZrC, Co and Ni were prepared, each of which having a prescribed average particle size ranging from 1 μm to 1.5 μm. These powders were blended in various blend compositions depicted in Tables 1 to 4 and were subjected to wet mixing in a ball mill for 72 hours. After being dried, each mixture was pressed into a green compact of a shape in conformity with SNMG120408 of the ISO Standards. Subsequently, the green compact was sintered under the following conditions:

Specifically, the green compact was first heated from the ordinary temperature to 1,100° C. in a vacuum, and further heated from 1,100° C. to 1,450° C. in a nitrogen atmosphere of 10 torr. Then, the atmosphere was removed to produce a vacuum of $10^{-2}$ torr, in which the compact was held for 1 hour and in which the subsequent cooling step was carried out.

With the above sintering procedures, cutting inserts 1 to 23 of the invention were manufactured.

Furthermore, for comparison purposes, the green compacts having the same compositions as the cutting inserts of the invention were prepared and sintered under the following conditions:

Specifically, each compact was heated from the ordinary temperature to 1,100° C. in a gaseous carbon monoxide (CO) atmosphere of 50 torr, and the subsequent operation, which included the temperature elevation step from 1,100° C. to 1,450° C. (starting temperature of the holding step), the holding step of the compact for 1 hour and the cooling step from the above temperature to the ordinary temperature, was effected in a vacuum of $10^{-2}$ torr. With these procedures, comparative cutting inserts 1 to 23 were produced as depicted in Tables 5 to 8.

Then, the hardness, which was based on micro Vickers (load: 100 g) measurements on an inclined surface having an angle of 11°, was measured for each cutting insert and the results are set forth in Tables 1 to 8. In the experiment, carbides and nitrides of a single element were used, but carbo-nitrides of a single element or a solid solution of composite carbides, nitrides or carbonitrides of plural elements could be used as well.

Subsequently, in order to evaluate fracture resistance characteristics, the cutting inserts thus obtained were subjected to dry-type interrupted cutting tests of steel under the following conditions:

Workpiece: square bar (JIS.SNCN439; Hardness: $H_B$270)
Cutting speed: 150 m/minute
Depth of cut: 2 mm
Feed rate: 0.3 mm/revolution
Cutting time: 2 minutes In this test, the number of inserts subjected to fracture per ten was determined.

Similarly, in order to evaluate the wear resistance, all of the cutting inserts were subjected to a dry-type continuous high-speed cutting test, and flank wear was observed. The conditions of this test were as follows:

Workpiece: round bar (JIS.SCM415; Hardness: $H_B$160)

Cutting speed: 300 m/minute

Depth of cut: 1.5 mm

Feed rate: 0.2 mm/revolution

Cutting time: 20 minutes

The results of the above two tests are set forth in Tables 1 to 8.

As clearly seen from the results, the inserts of the present invention are comparable to the comparative cutting inserts in the degree of wear resistance. However, the inserts of the present invention exhibit greater fracture resistance characteristics than the comparative inserts.

TABLE 1

| Cutting Inserts of the Invention | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 1 | Ni:6 TaC:8 $Mo_2C$:10 TiN:20 TiC:other | Ni:6 (Ti, Ta, Mo) (CN):other | 0.24 | 1780 | 88.1 | 2020 | 5 | 1720 | 3/10 | 0.11 |
| 2 | Co:8 Ni:4 NbC:2 TaC:10 WC:10 $Mo_2C$:10 TiN:30 TiC:other | Co:8 Ni:4 TiN:6 (Ti, Ta, Nb, W, Mo) (CN):other | 0.44 | 590 | 26.5 | 2230 | 40 | 1680 | 3/10 | 0.12 |
| 3 | Co:4 Ni:8 NbC:3 TaC:10 WC:10 $Mo_2C$:10 TiN:30 TiC:other | Co:4 Ni:8 TiN:5 (Ti, Nb, Ta, W, Mo) (CN):other | 0.45 | 1580 | 75.6 | 2090 | 15 | 1670 | 1/10 | 0.12 |
| 4 | Co:10 Ni:5 NbC:5 TaC:10 WC:10 TiN:35 TiC:other | Co:10 Ni:5 TiN:10 (Ti, Ta, Nb, W) (CN):other | 0.50 | 730 | 37.2 | 1960 | 45 | 1650 | 0/10 | 0.24 |
| 5 | Co:12 Ni:4 TaC:15 WC:15 TiN:35 TiC:other | Co:12 Ni:4 TiN:8 (Ti, Ta, W) (CN):other | 0.55 | 1630 | 85.3 | 1910 | 15 | 1650 | 0/10 | 0.18 |
| 6 | Co:12 Ni:4 TaC:10 WC:30 TiN:25 TiC:other | Co:12 Ni:4 WC:8 (Ti, Ta, W) (CN):other | 0.44 | 1680 | 87.5 | 1960 | 20 | 1670 | 0/10 | 0.22 |

TABLE 2

| Cutting Inserts of the Invention | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 7 | Co:12 Ni:6 NbC:2 TaC:15 WC:15 TiN:20 TiC:other | Co:12 Ni:6 (Ti, Ta, Nb, W) (CN):other | 0.32 | 1600 | 87.9 | 1920 | 10 | 1590 | 0/10 | 0.16 |
| 8 | Co:10 Ni:8 TaC:5 NbC:5 WC:15 TiN:30 TiC:other | Co:10 Ni:8 TiN:5 (Ti, Ta, Nb, W) (CN):other | 0.45 | 1480 | 80.4 | 1940 | 20 | 1540 | 0/10 | 0.18 |
| 9 | Co:12 Ni:6 NbC:5 TaC:5 WC:25 TiN:35 TiC:other | Co:12 Ni:6 WC:10 TiN:3 (Ti, Ta, Nb, W) (CN):other | 0.59 | 860 | 44.6 | 1930 | 40 | 1520 | 0/10 | 0.25 |
| 10 | Co:10 Ni:6 NbC:2 TaC:10 WC:35 TiN:25 TiC:other | Co:10 Ni:6 WC:13 (Ti, Ta, Nb, W) (CN):other | 0.47 | 1280 | 63.7 | 2010 | 30 | 1610 | 0/10 | 0.25 |
| 11 | Co:12 Ni:6 NbC:3 TaC:8 WC:5 $Mo_2C$:8 TiN:35 TiC:other | Co:12 Ni:6 TiN:8 (Ti, Ta, Nb, W, Mo) (CN) | 0.52 | 1180 | 57.6 | 2050 | 35 | 1540 | 0/10 | 0.19 |
| 12 | Co:15 Ni:10 NbC:5 TaC:10 TiN:45 TiC:other | Co:15 Ni:10 TiN:12 (Ti, Ta, Nb) (CN): | 0.68 | 1380 | 76.7 | 1960 | 45 | 1450 | 0/10 | 0.27 |

TABLE 3

| Cutting Inserts of the Invention | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 13 | Co:14 Ni:14 ZrC:0.5 NbC:5 $Mo_2C$:10 TiN:20 TiC:other | Co:14 Ni:14 (Ti, Zr, Nb, Mo) (CN):other | 0.31 | 1500 | 82.9 | 1960 | 25 | 1400 | 0/10 | 0.28 |
| 14 | Co:14 Ni:14 ZrC:0.1 NbC:3 TaC:10 WC:10 TiN:40 TiC:other | Co:14 Ni:14 TiN:10 (Ti, Zr, Nb, Ta, W) (CN):other | 0.46 | 680 | 33.8 | 2010 | 40 | 1380 | 0/10 | 0.30 |

TABLE 3-continued

| Cutting Inserts of the Invention | Blend Composition (% by weight) | Composition of Substrate (% by weight) | b / a + b | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 15 | Co:4 Ni:4 TaC:8 WC:6 $Mo_2C$:8 TiN:20 TiC:other | Co:4 Ni:4 (Ti, Ta, W, Mo) (CN):other | 0.25 | 1600 | 80.8 | 1980 | 10 | 1680 | 2/10 | 0.15 |
| 16 | Co:6 Ni:6 TaC:10 WC:8 $Mo_2C$:5 TiN:40 TiC:other | Co:6 Ni:6 TiN:10 (Ti, Ta, W, Mo) (CN):other | 0.55 | 760 | 35.8 | 1650 | 45 | 1650 | 1/10 | 0.17 |
| 17 | Co:7 Ni:7 NbC:2 TaC:4 WC:10 $Mo_2C$:10 TiN:30 TiC:other | Co:7 Ni:7 TiN:5 (Ti, Ta, Nb, W, Mo) (CN):other | 0.43 | 1630 | 75.8 | 2150 | 5 | 1640 | 0/10 | 0.16 |
| 18 | Co:8 Ni:10 NbC:5 TaC:5 WC:8 $Mo_2C$:8 TiN:30 TiC:other | Co:8 Ni:10 TiN:5 (Ti, Ta, Nb, W, Mo) (CN):other | 0.45 | 870 | 41.8 | 2080 | 40 | 1570 | 0/10 | 0.20 |

TABLE 4

| Cutting Inserts of the Invention | Blend Composition (% by weight) | Composition of Substrate (% by weight) | b / a + b | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 19 | Co:16 NbC:10 WC:15 TiN:40 TiC:other | Co:16 TiN:10 (Ti, Nb, W) (CN):other | 0.57 | 1670 | 87.0 | 1920 | 10 | 1650 | 0/10 | 0.19 |
| 20 | Co:10 Ni:12 TaC:5 $Mo_2C$:10 WC:8 TiN:35 TiC:other | Co:10 Ni:12 TiN:8 (Ti, Ta, W, Mo) (CN):other | 0.56 | 610 | 28.6 | 2130 | 45 | 1420 | 0/10 | 0.25 |
| 21 | Co:12 Ni:6 TaC:10 $Mo_2C$:10 WC:15 TiN:20 TiC:other | Co:12 Ni:6 (Ti, Ta, Mo, W) (CN):other | 0.34 | 1520 | 80.4 | 1890 | 5 | 1620 | 0/10 | 0.20 |
| 22 | Co:10 Ni:10 $Mo_2C$:15 TiN:25 TiC:other | Co:10 Ni:10 TiN:3 (Ti, Mo) (CN):other | 0.35 | 1460 | 77.7 | 1880 | 10 | 1450 | 0/10 | 0.23 |
| 23 | Co:20 Ni:5 TaC:5 $Mo_2C$:5 WC:10 TiN:25 HfC:0.5 TiC:other | Co:20 Ni:5 TiN:3 (Ti, Ta, Mo, W, Hf) (CN):other | 0.40 | 1210 | 65.4 | 1910 | 14 | 1430 | 0/10 | 0.26 |

TABLE 5

| Comparative Cutting Inserts | Blend Composition (% by weight) | Composition of Substrate (% by weight) | b / a + b | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 1 | Ni:6 TaC:8 $Mo_2C$:10 TiN:20 TiC:other | Ni:6 (Ti, Ta, Mo) (CN):other | 0.18 | 1920 | — | 1920 | — | 1730 | 10/10 | 0.25 |
| 2 | Co:8 Ni:4 NbC:2 TaC:10 WC:10 $Mo_2C$:10 TiN:30 TiC:other | Co:8 Ni:4 (Ti, Ta, Nb, W, Mo) (CN):other | 0.38 | 1870 | — | 1870 | — | 1670 | 9/10 | 0.28 |
| 3 | Co:4 Ni:8 NbC:3 TaC:10 WC:10 $Mo_2C$:10 TiN:30 TiC:other | Co:4 Ni:8 (Ti, Nb, Ta, W, Mo) (CN):other | 0.35 | 1950 | — | 1950 | — | 1670 | 9/10 | 0.27 |
| 4 | Co:10 Ni:5 NbC:5 NbC:10 WC:10 TiN:35 TiC:other | Co:10 Ni:5 TiN:3 (Ti, Ta, Nb, W) (CN):other | 0.36 | 1860 | — | 1860 | — | 1650 | 9/10 | 0.30 |
| 5 | Co:12 Ni:4 TaC:15 WC:15 TiN:35 TiC:other | Co:12 Ni:4 TiN:3 (Ti, Ta, W) (CN):other | 0.48 | 1880 | — | 1880 | — | 1630 | 8/10 | 0.28 |
| 6 | Co:12 Ni:4 TaC:10 WC:30 TiN:25 TiC:other | Co:12 Ni:4 (Ti, Ta, W) (CN):other | 0.38 | 1890 | — | 1890 | — | 1650 | 7/10 | 0.30 |

TABLE 6

| Comparative Cutting Inserts | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 7 | Co:12 Ni:6 NbC:2 TaC:15 WC:15 TiN:20 TiC:other | Co:12 Ni:6 (Ti, Ta, Nb, W) (CN):other | 0.25 | 1830 | — | 1830 | — | 1620 | 7/10 | 0.30 |
| 8 | Co:10 Ni:8 TaC:5 NbC:5 WC:15 TiN:30 TiC:other | Co:10 Ni:8 (Ti, Ta, Nb, W) (CN):other | 0.41 | 1810 | — | 1810 | — | 1530 | 7/10 | 0.31 |
| 9 | Co:12 Ni:6 NbC:5 TaC:5 WC:25 TiN:35 TiC:other | Co:12 Ni:6 TiN:3 (Ti, Ta, Nb, W) (CN):other | 0.48 | 1800 | — | 1800 | — | 1510 | 7/10 | 0.32 |
| 10 | Co:10 Ni:6 NbC:2 TaC:10 WC:35 TiN:25 TiC:other | Co:10 Ni:6 WC:4 (Ti, Ta, Nb, W) (CN):other | 0.41 | 1910 | — | 1910 | — | 1590 | 8/10 | 0.28 |
| 11 | Co:12 Ni:6 NbC:3 TaC:8 WC:5 $Mo_2C$:8 TiN:35 TiC:other | Co:12 Ni:6 (Ti, Ta, Nb, W, Mo) (CN) | 0.39 | 1850 | — | 1850 | — | 1560 | 7/10 | 0.33 |
| 12 | Co:15 Ni:10 NbC:5 TaC:10 TiN:45 TiC:other | Co:15 Ni:10 TiN:5 (Ti, Ta, Nb) (CN):other | 0.58 | 1800 | — | 1800 | — | 1480 | 7/10 | 0.47 |

TABLE 7

| Comparative Cutting Inserts | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 13 | Co:14 Ni:14 ZrC:0.5 NbC:5 $Mo_2C$:10 TiN:20 TiC:other | Co:14 Ni:14 (Ti, Zr, Nb, Mo) (CN):other | 0.27 | 1790 | — | 1790 | — | 1420 | 6/10 | 0.55 |
| 14 | Co:14 Ni:14 ZrC:0.1 NbC:3 TaC:10 WC:10 TiN:10 TiC:other | Co:14 Ni:14 TiN:3 (Ti, Zr, Nb, Ta, W) (CN):other | 0.33 | 1710 | — | 1710 | — | 1390 | 6/10 | 0.58 |
| 15 | Co:4 Ni:4 TaC:8 WC:6 $Mo_2C$:8 TiN:20 TiC:other | Co:4 Ni:4 (Ti, Ta, W, Mo) (CN):other | 0.19 | 1890 | — | 1890 | — | 1710 | 10/10 | 0.25 |
| 16 | Co:6 Ni:6 TaC:10 WC:8 $Mo_2C$:5 TiN:40 TiC:other | Co:6 Ni:6 TiN:3 (Ti, Ta, W, Mo) (CN):other | 0.43 | 1840 | — | 1840 | — | 1640 | 8/10 | 0.47 |
| 17 | Co:7 Ni:7 NbC:2 TaC:4 WC:10 $Mo_2C$:10 TiN:30 TiC:other | Co:7 Ni:7 (Ti, Ta, Nb, W, Mo) (CN):other | 0.43 | 1920 | — | 1920 | — | 1660 | 10/10 | 0.26 |
| 18 | Co:8 Ni:10 NbC:5 TaC:5 WC:8 $Mo_2C$:8 TiN:30 TiC:other | Co:8 Ni:10 (Ti, Ta, Nb, W, Mo) (CN):other | 0.36 | 1840 | — | 1840 | — | 1560 | 7/10 | 0.33 |

TABLE 8

| Comparative Cutting Inserts | Blend Composition (% by weight) | Composition of Substrate (% by weight) | b/(a + b) | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| 19 | Co:16 NbC:10 WC:15 TiN:40 TiC:other | Co:16 TiN:3 (Ti, Nb, W) (CN):other | 0.48 | 1830 | — | 1830 | — | 1650 | 9/10 | 0.30 |
| 20 | Co:10 Ni:12 TaC:5 $Mo_2C$:10 WC:8 TiN:35 TiC:other | Co:10 Ni:12 (Ti, Ta, W, Mo) (CN):other | 0.49 | 1770 | — | 1770 | — | 1430 | 6/10 | 0.56 |
| 21 | Co:12 Ni:6 TaC:10 $Mo_2C$:10 WC:15 TiN:20 TiC:other | Co:12 Ni:6 (Ti, Ta, Mo, W) (CN):other | 0.28 | 1880 | — | 1880 | — | 1630 | 8/10 | 0.29 |
| 22 | Co:10 Ni:10 $Mo_2C$:15 TiN:25 TiC:other | Co:10 Ni:10 (Ti, Mo) (CN):other | 0.29 | 1810 | — | 1810 | — | 1480 | 7/10 | 0.40 |
| 23 | Co:20 Ni:5 TaC:5 $Mo_2C$:5 WC:10 TiN:25 | Co:20 Ni:5 (Ti, Ta, Mo, W, Hf) (CN):other | 0.34 | 1760 | — | 1760 | — | 1420 | 8/10 | 0.49 |

TABLE 8-continued

| Comparative Cutting Inserts | Blend Composition (% by weight) | Composition of Substrate (% by weight) | $\frac{b}{a+b}$ | Substrate hardness (Hv) | Surface hardness percent (%) | Maximum Hardness Hardness (Hv) | Maximum Hardness Depth (μm) | Internal Hardness | Fractured Inserts / Tested Inserts | Frank Wear Width (mm) |
|---|---|---|---|---|---|---|---|---|---|---|
| | HfC:0.5 TiC:other | | | | | | | | | |

What is claimed is:

1. A process for producing a blade member for cutting-tools, comprising the steps of:

(a) mixing powders of said binder phase for forming the binder and said hard dispersed phases to provide a powder mixture of a binder phase of 5% to 30% by weight of at least one element selected from the group consisting of cobalt and nickel; and a hard dispersed phase of a balance composite carbonitride of titanium and at least one element selected from the group consisting of tungsten, molybdenum, tantalum, niobium, hafnium and zirconium, said composite carbo-nitride satisfying the relationship of $0.2 \leqq b/(a+b) \leqq 0.7$, where a and b denote atomic ratios of carbon and nitrogen, respectively;

(b) compacting said powder mixture into a green compact; and (c) sintering said green compact to provide the cermet substrate, said sintering including effecting initial temperature elevation to 1,100° C. in a non-oxidizing atmosphere; subsequent temperature elevation from 1,100° C. to a temperature range between 1,400° C. and 1,500° C. in a nitrogen atmosphere; and a subsequent sintering operation in a denitrifying atmospohere to obtain a hard surface layer in which the region having the maximum hardness is present at a depth from 5 μm and 50 μm from a substrate surface thereof said substrate surface having a hardness of 20% to 90% of said maximum hardness.

2. The process of claim 1, in which said dispersed phase further contains at least one compound selected from the group consisting of tungsten carbide and titanium nitride.

* * * * *

UNITED STATES PATENT AND TRADEMARK OFFICE

CERTIFICATE OF CORRECTION

PATENT NO. : 5,110,543

DATED : May 5, 1992

INVENTOR(S) : Niro Odani, et al.

It is certified that error appears in the above-identified patent and that said Letters Patent is hereby corrected as shown below:

Column 2, line 58: "5%" should read as --30%--

Column 3, line 37: "element" should read as --element.--

Column 3, line 45: "sintered" should read as --sintered.--

Column 3, line 59: "ma" should read as --may--

Column 5, line 54, Table 2: "(CN):" should read as --(CN):other--

Signed and Sealed this

Tenth Day of August, 1993

*Attest:*

*Attesting Officer*

Michael K. Kirk

MICHAEL K. KIRK

*Acting Commissioner of Patents and Trademarks*